US006773064B2

(12) United States Patent
Treen et al.

(10) Patent No.: US 6,773,064 B2
(45) Date of Patent: Aug. 10, 2004

(54) BOOSTER SEAT

(75) Inventors: J. Michael Treen, Jamaica Plain, MA (US); Jorge Tomas, Wrentham, MA (US); Michael T. Fusco, Johnston, RI (US); Brian Sundberg, Chester, NH (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/241,608

(22) Filed: Sep. 11, 2002

(65) Prior Publication Data

US 2003/0067198 A1 Apr. 10, 2003

Related U.S. Application Data

(60) Provisional application No. 60/322,404, filed on Sep. 14, 2001.

(51) Int. Cl.[7] ..... A47D 1/10
(52) U.S. Cl. ..... 297/255; 297/153
(58) Field of Search ..... 297/17, 54, 153, 297/250.1, 255, 256.16

(56) References Cited

U.S. PATENT DOCUMENTS

| | | | | |
|---|---|---|---|---|
| 1,163,628 A | * | 12/1915 | Gibson | 297/153 |
| 1,739,366 A | | 12/1929 | Lang | |
| 2,089,090 A | * | 8/1937 | Di Giacomo et al. | 297/129 |
| 2,603,274 A | * | 7/1952 | McClernon | 297/37 |
| 3,516,709 A | | 6/1970 | Nader | |
| 3,635,522 A | * | 1/1972 | Kerwit | 297/153 |
| 3,909,061 A | * | 9/1975 | Johnson | 297/17 |
| 4,193,630 A | * | 3/1980 | Steele | 297/17 |
| 5,183,311 A | | 2/1993 | Meeker et al. | |
| 5,234,143 A | | 8/1993 | Mahvi et al. | |
| 5,335,968 A | * | 8/1994 | Sheridan et al. | 297/250.1 |
| 5,474,355 A | | 12/1995 | Lerner et al. | |
| 5,609,389 A | | 3/1997 | Longoria et al. | |

FOREIGN PATENT DOCUMENTS

| | | |
|---|---|---|
| EP | 0 369 693 | 5/1990 |

OTHER PUBLICATIONS

PCT/US02/29201 international search report dated Feb. 12, 2002.

* cited by examiner

*Primary Examiner*—Peter M. Cuomo
*Assistant Examiner*—Joseph Edell
(74) *Attorney, Agent, or Firm*—Barnes & Thornburg LLP

(57) ABSTRACT

A booster seat having a base 10 with foldable legs 20 to raise and lower the base. A seat assembly 12 is provided on the base having a seating surface 50 and arms 52. A backrest 14 is pivotally connected to the seat assembly 12 and moves between an operative erect position and a stored collapsed position wherein it lies substantially parallel to and closely adjacent the seating surface 50. A tray 16 is selective mountable on the seat assembly 12 for use by a child seated in the booster and a stored position on the bottom of the base 10. A retractable strap assembly is mounted in the base having one pair of straps 168 and 169 for wrapping around the seat and a second pair of straps 164 and 165 for wrapping around the back of a chair on which the booster is supported.

31 Claims, 8 Drawing Sheets

BOOSTER SEAT

RELATED APPLICATION

This application claims the benefits of copending provision application Serial No. 60/322,404 filed Sep. 14, 2001 and entitled BOOSTER SEAT, and is incorporated herein by reference in its entirety.

FIELD OF THE INVENTION

This invention relates to booster seats and more particularly is directed to a portable booster seat that is convenient, safe and durable.

SUMMARY OF THE INVENTION

In accordance with one aspect of the invention, the booster seat is foldable so that when not in use it closes to a small volume for convenience in storing the device and transporting it from place-to-place.

In accordance with another aspect of the present invention the booster seat provides a height adjustment so that it can be used generally for children from 6 months to 4 years of age.

In accordance with yet another aspect of the present invention, retractable straps are incorporated into the device that may typically be used to extend under the seat of a chair as well as around the back of the chair on which the booster is used. The retractable nature of the straps assures that they will not be lost, and the straps also include a convenience buckle arrangement for easy release by an adult.

In accordance with another aspect of the present invention, the booster includes a detachable tray that provides a convenient surface on which the child may eat and play, but which is removable so that the booster seat may be used without it. Furthermore, when not in use, the tray may be stored by attachment to the bottom of the booster so as to enclose the legs that provide the height adjustment, and the tray when so stored forms a compact unit when the booster seat is collapsed.

As yet another aspect of the present invention, the booster seat includes a three-point adjustable restraint which is very easy for an adult to release, but which will hold the child in the seat, particularly when the tray is removed.

In accordance with yet another aspect of the present invention, a handy storage compartment is built into the booster and is accessible when the booster is either collapsed or erect.

As still another aspect of the invention, a handle is incorporated into the booster to further enhance the convenience of the item by making it easily transportable.

The booster seat in accordance with one embodiment of the invention, includes a pair of extendable legs that in an unextended position lie within the base of the booster to lower the seating surface of the booster to provide an appropriate seat for a larger child, particularly when seated at a table, and when moved to the extended position, renders the booster particularly suitable for use by a smaller child.

In one embodiment of the invention, the backrest of the booster folds downwardly to lie above the surface of the seat so as to reduce the volume of the booster for storage or travel. The tray is removably attached to the arms of the booster, which enables the tray to be removed for washing or for attachment to the base of the booster. When attached to the arms the tray provides a play or eating surface for the child.

The strap system in accordance with one embodiment of the invention is built into the base of the booster and includes a pair of spools, one for the strap that extends under the seat of a chair on which the booster is used and the other for the strap that may extend about the backrest of a chair. In accordance with the preferred embodiment of the invention, the two spools are operatively connected so that the winding of one spool to retract its strap will also cause the other spool to rotate and retract the second strap, assuming that both straps are extended.

The adjustable restraint in accordance with one embodiment of the invention includes a crotch strap that extends upwardly from the center of the front portion of the seat as well as a pair of safety straps separately connected to the sides of the seat and that buckle to the crotch strap. An easy buckle arrangement joins the three straps together so that an adult attending to the child in the seat may easily lift the child with one hand and release the buckle with the other.

The invention will be better understood and appreciated from the following detailed description with reference to the accompanying drawings.

DETAILED DESCRIPTION

Figure 1:
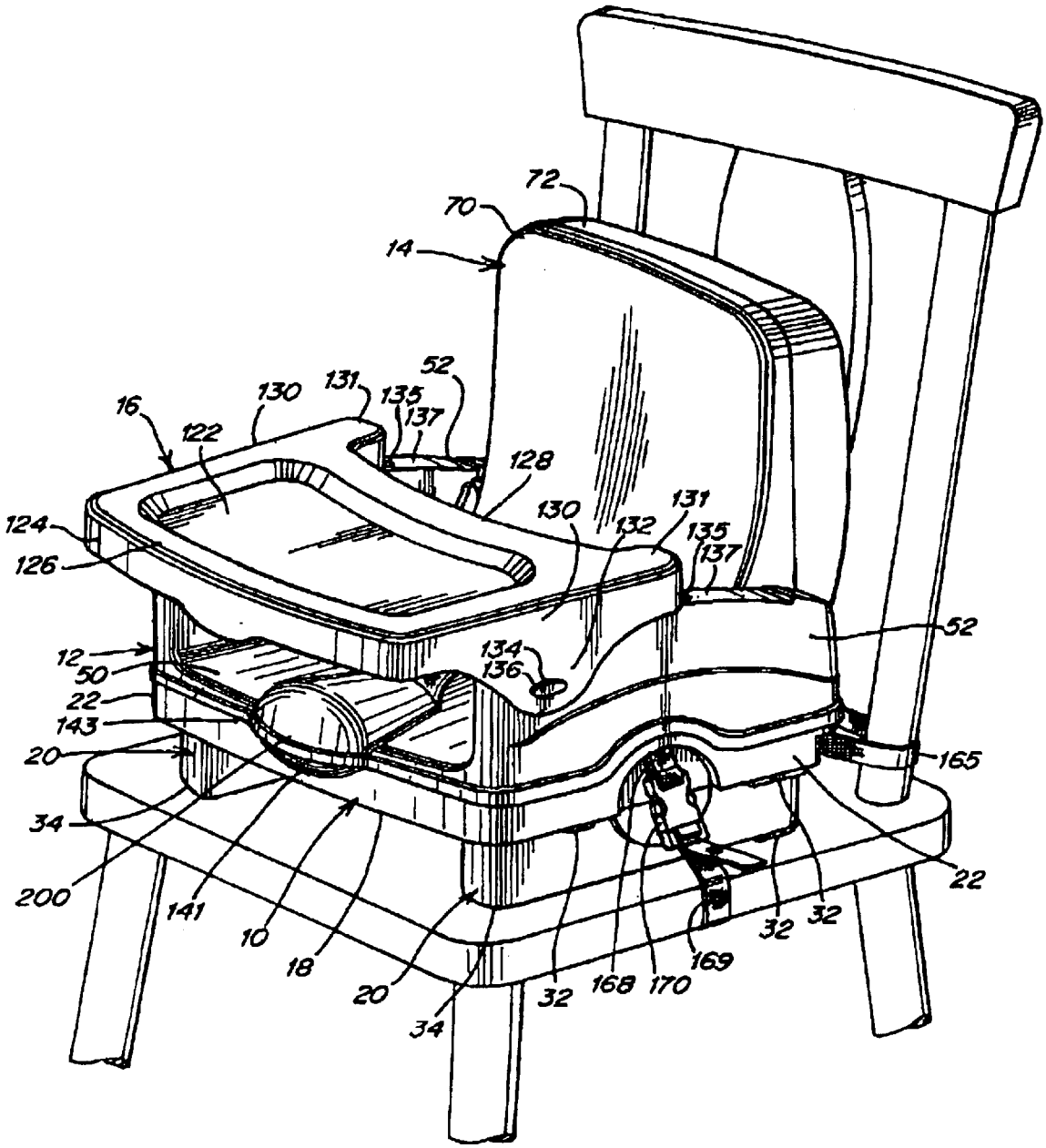
FIG. 1 is a perspective view of a booster seat embodying the present invention mounted on a chair and with the booster seat legs extended so as to elevate the seat for use by a younger child, and with the tray in the operative position.

The booster seat shown in one preferred embodiment illustrated in the drawings includes a base 10, seat 12, backrest 14 and tray 16. In accordance with one aspect of this invention, the elements identified above are injection molded of a plastic material such as polypropylene, but it is to be understood that the various parts of the booster seat may be made of different materials and by different forming processes.

Figure 2:
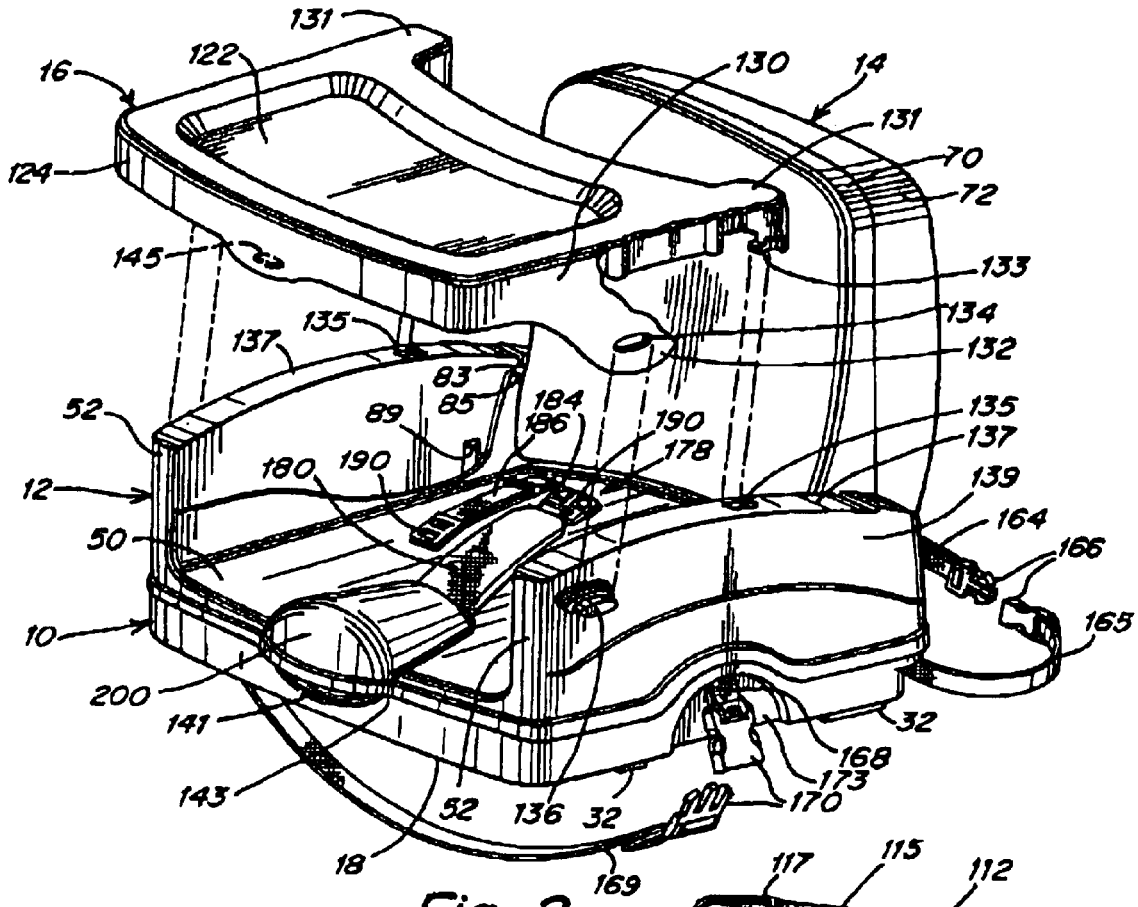
FIG. 2 is a partially exploded, perspective view of the booster seat shown in FIG. 1, but with its legs collapsed to accommodate an older child, and with the tray detached.

In accordance with one aspect of the illustrated embodiment, the base 10 supports a pair of legs 20 that extend front to back adjacent the sides 22 of the base. In this embodiment, the legs are supported for pivotal motion adjacent their front and rear ends, 26, 28, respectively, so as to enable the legs to move from an active or operative position as shown in FIG. 1, wherein the legs extend downwardly so as to elevate the base 22 above the supporting surface on which the booster seat rests, and an inactive or collapsed position wherein the legs are disposed in the base as shown in FIG. 2 so as to enable the base to sit directly on the supporting surface on which it rests to lower the seat 12. Preferably, both the bottom surface 18 of the base 10 and the lower edges 34 of the legs carry gripper feet 32 that will restrain slipping of the booster seat on its supporting surface whether or not the legs 20 are deployed.

Figure 12:
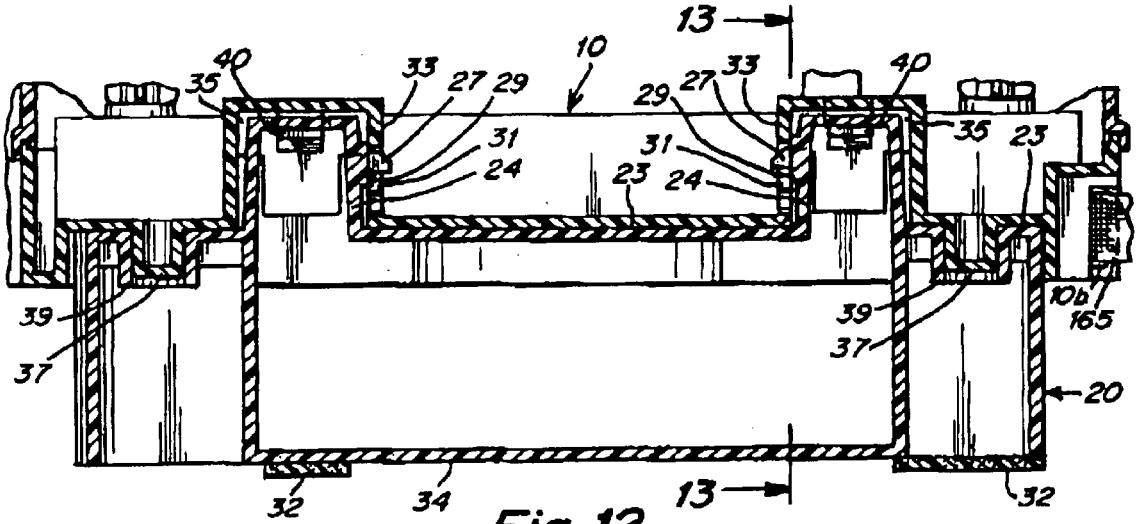
Figure 13:
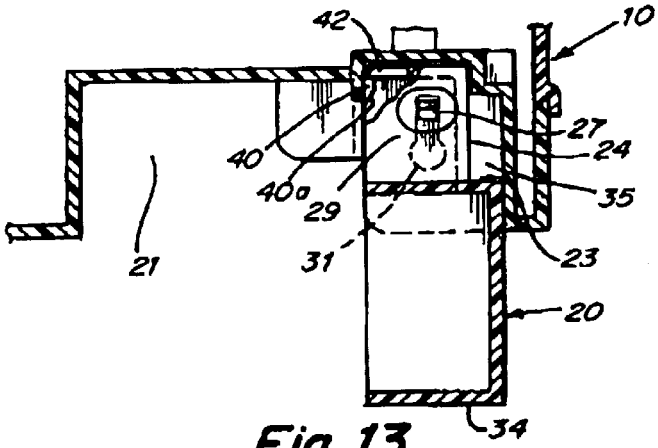
FIG. 13 is a fragmentary cross-sectional view taken along section line 13—13 in FIG. 12 with a leg in the operative position.
Figure 14:
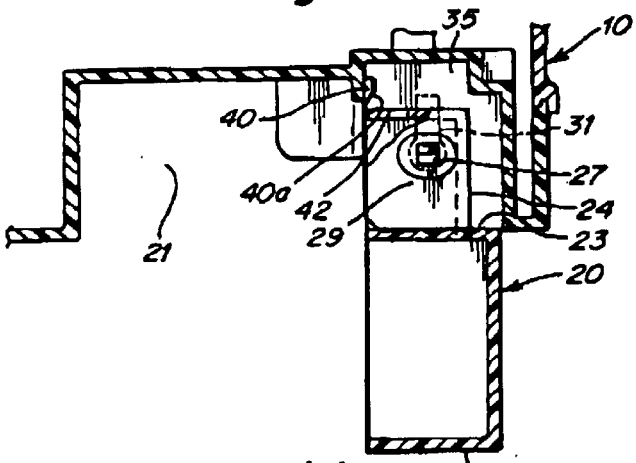
FIGS. 14–16 are fragmentary cross-sectional views similar to FIG. 13 and FIG. 11, respectively but showing the sequence of the positions of the leg as it moves from the operative to the collapsed position stored in the base.

As is shown in FIGS. 6, 7, 10, 11 and 13–16 cavities 21 are provided in the bottom surface of the base 10 for receiving the legs 20 when folded to their inactive positions. The mounting arrangement for the legs in the embodiment illustrated is shown in detail in FIGS. 11–16. The legs on their upper surface 23 carry a pair of extensions 24 with lugs 27 on their 'opposed walls 29 that are disposed in keyhole slots 31 provided in the adjacent sides 33 of cavities 35 that receive the extensions 24. When the legs 20 are in their deployed positions as in FIG. 12, lugs 27 will be at the tops of the slots 31 as shown in FIGS. 12 and 13. However, when the legs 20 are in their stored position in the cavities 21, the lugs 27 serve as pivots in the enlarged lower ends of the keyhole slots 31 (see FIGS. 14–16) that enable the legs to swing through 90° between the stored and deployed positions. When the legs 20 are pivoted to their deployed position, they can move up and down translationally with the tugs 27 in the keyhole slots 31 so that posts 37 carried on the base 10 may be brought into registration with sleeves 39 in the upper surface 23 of the legs to hold the legs firmly in the vertical deployed position.

Figure 7:
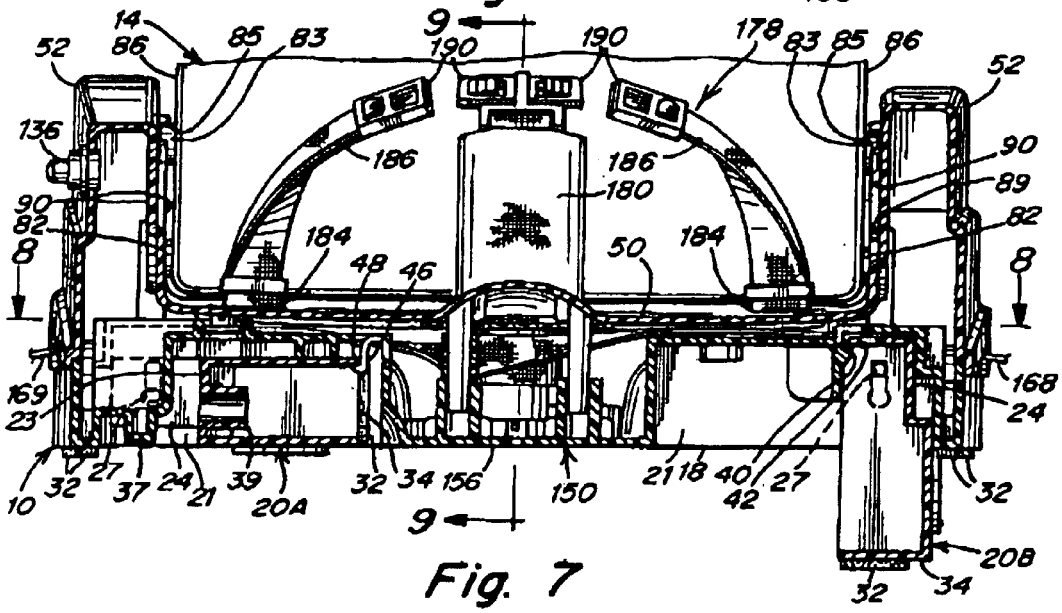
FIG. 7 is a cross-sectional elevation view of the booster taken along section line 7—7 in FIG. 6.

In the embodiment shown, a flange 40 on the base 10 engages the edge 42 of the top of each extension 24 (see FIG. 13) to hold the leg in the elevated position with the posts 37 and sleeves 39 in registration with one another (see right leg 20B in FIG. 7). When the leg is to be pivoted to the stored position, edge: 42 snaps past the flange 40 and releases the edge' of the extension so that the leg can be lowered, disconnecting the posts 37 and sleeves 39, and lug 27 moves to the bottom of the keyhole 31 slots to allow the leg to then pivot to the stored position (see FIGS. 15 and 16). It will be noted that a ramp 40*a* is provided on the bottom of the flange 40 to enable the edge 42 to ride up over the flange when the leg is deployed.

Figure 15:
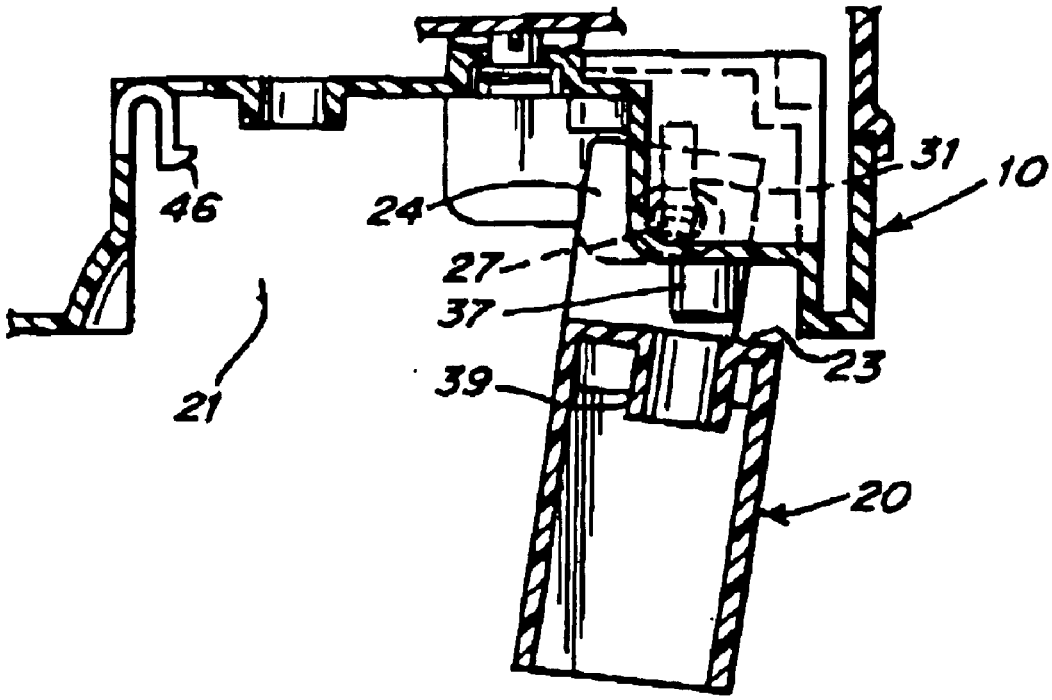
Figure 16:
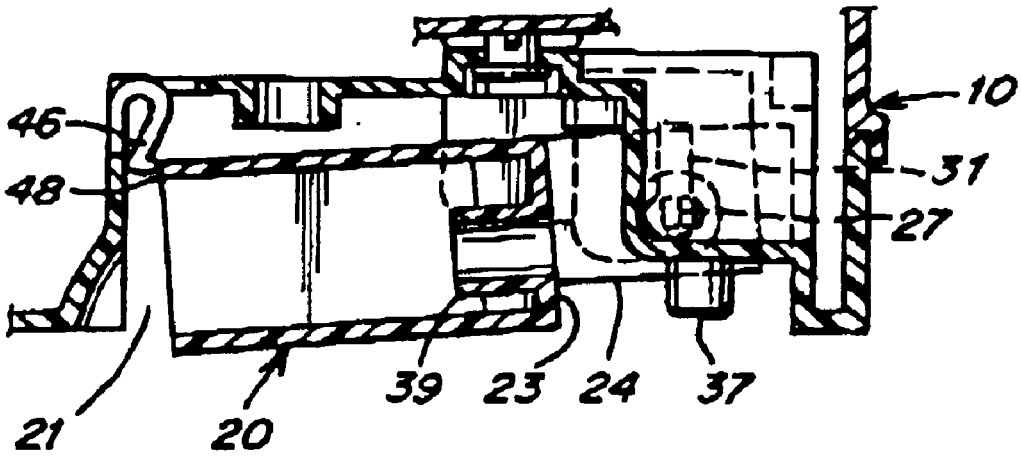

A friction fit may also exist between the posts 37 and the sleeves 39 as an alternative or in addition to the flanges 40 to releasably hold the legs in the operative position. It will be appreciated that when the child's weight is applied to the booster seat, it will exert a force on the seat to further maintain the connection between the posts 37 and sleeves 39. In FIGS. 15 and 16 a hook-like spring catch 46 is shown in the cavity 21 for releasably latching onto the edge 48 the leg 20 to hold it in the stored position. The leg may be freed by overcoming the catch. In the preferred embodiment two such catches 46 are employed, one adjacent each end of each of the two legs.

The seat 12 shown in FIG. 2 which together with the base 10 forms a bottom member for the booster, has a contoured surface 50 for the comfort of the child and includes a pair of upstanding arms 52 running front to back along the sides thereof. In the illustrated embodiment of the invention, the seat 12 and base 10 are separately fabricated and later connected together. The two may be releasably or permanently locked together by barbs and openings, nuts and screws, poppet-type connectors, ultrasonic welding or by other means. In normal use the two may be treated as a single member. The arms 52 of the seat in the embodiment shown are rigidly connected with respect to the seating surface 50, but it is to be understood that the arms may also be separately fabricated and connected together.

Figure 4:
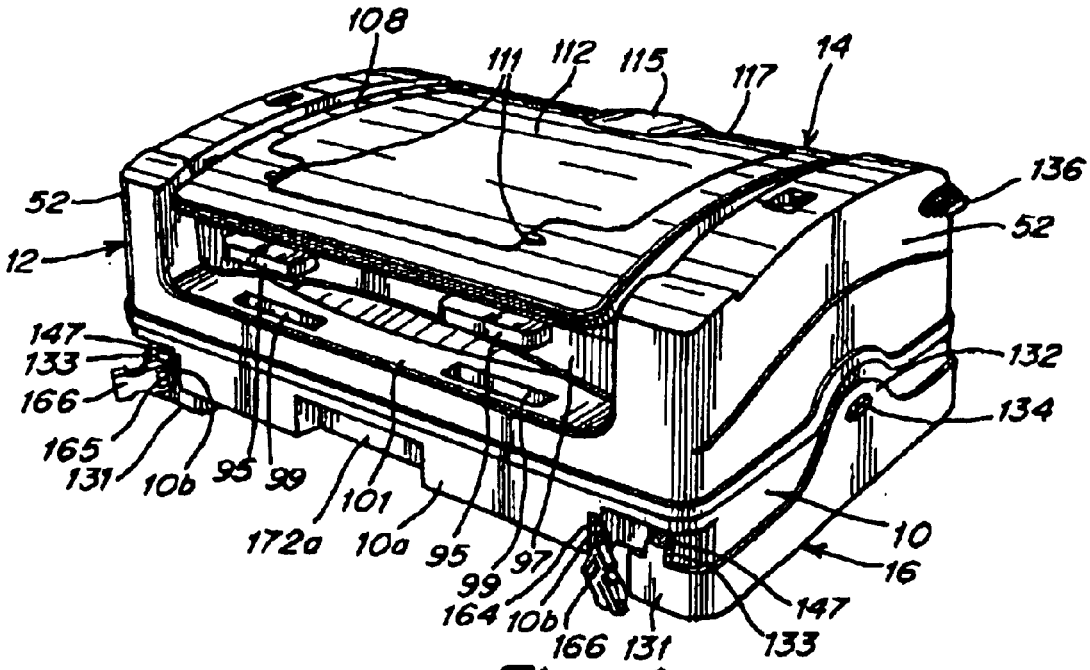
FIG. 4 is a rear perspective view of the collapsed booster with the storage compartment closed.
Figure 9:
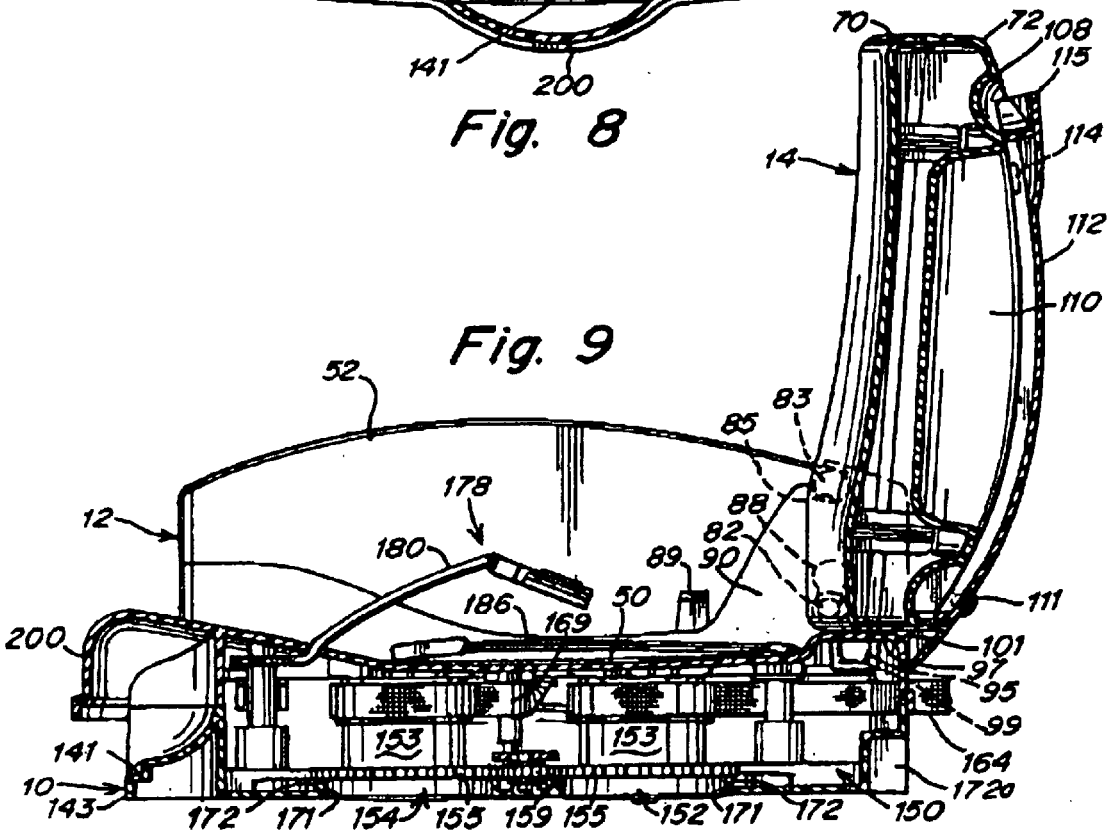
FIG. 9 is a cross-sectional side view of the booster with the backrest elevated, taken along section line 9—9 in FIG. 8.
Figure 10:
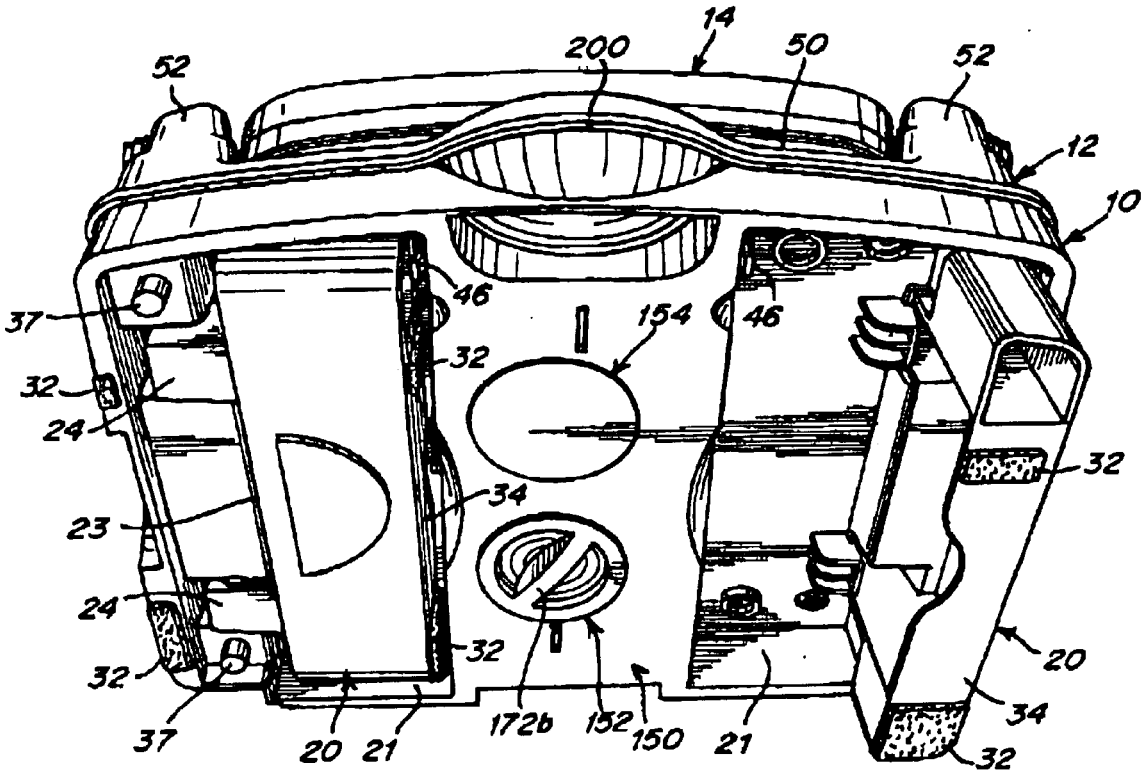
FIG. 10 is a bottom perspective view of the booster seat showing one leg in the operative position and the other in the collapsed position within the base.
Figure 11:
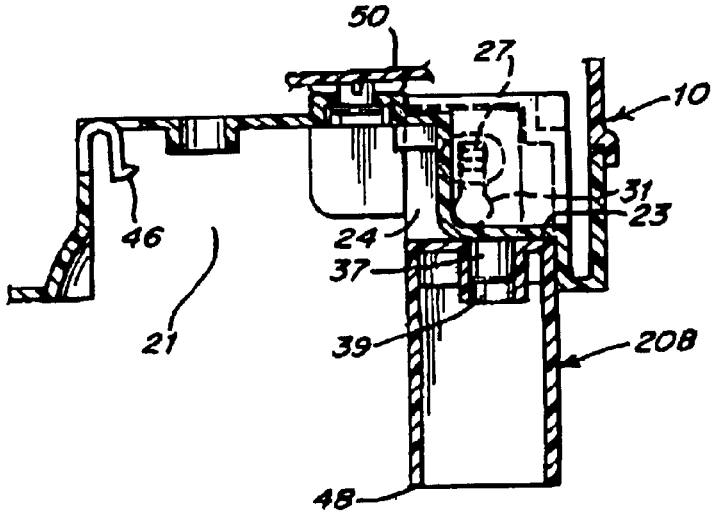
FIGS. 11 and 12 are fragmentary cross-sectional views taken along the sections lines 11—11 and 12—12 in FIG. 6.

The back 14 in the embodiment shown and in accordance with another aspect of the invention comprises a front portion 70 and a rear portion 72 that may be molded separately and secured together by fasteners (not shown) such as snap fasteners and slots on the front and rear portions, or by any other expedient such as suggested above to connect the base 10 and seat 12. Once connected together, the front and rear portions would not ordinarily be separated and therefore the fasteners may be of substantial size and stiffness so as to make it difficult to separate the two. The assembled back 14 carries a pair of axles 82 extending from its sides 86, that are received in keyhole-shaped openings 88 on the insides 90 of the arms 52 at the rear thereof as shown in FIGS. 7 and 9. It will be noted that the openings 88 are vertically elongated so as to enable the axles 82 and thus the backrest 14 to be elevated on the arms 52. The sides of the backrest 14 also carry posts 83 that extend outwardly therefrom and fit within slots 85 formed in the inner surfaces of the arms and open in an upwardly and forwardly direction as also shown in FIG. 9. To further support the backrest 14 in the operative position, one or more flanges 95, (two are shown in FIG. 4) may be provided along the bottom edge 97 of the backrest 14 that register with corresponding recesses 99 along the rear 101 of the seat 12. When the seat is placed in the operative position the flanges 95 are disposed in the recesses and further assist in holding the backrest erect. Before the backrest can be pivoted to the collapsed position, the flanges 95 must be withdrawn from the recesses 99 as the posts 83 are freed from the slots 85. When the back is elevated to free the posts 83 and flanges 95, it may be pivoted to a position spaced a short distance above and substantially parallel to the surface 50 of the seat 12. To releasably retain the backrest in the folded position, short snap-type flanges 89 (one shown in FIG. 2) are formed in the lower rear portion of the arms to engage the posts 83. The backrest is retained in the upright position by virtue of the shape of the slots 85 that are somewhat narrowed at their openings so that the posts 83 snap in and out of them.

The similarity of the pivotal actions of the backrest 14 and the legs 20 in the illustrated embodiment will be recognized. Both are pivotally mounted, but both also move translationally as well, to achieve the stored and deployed positions. It should be appreciated that other arrangements may be employed to enable the backrest and legs to be moved between the deployed and stored positions and to be retained in those positions. As one alternative arrangement, the legs and the backrest may be detachably connected to the base and/or seat and be disconnected from them when their positions are to be changed. Snaps or other types of connectors may be used to hold the legs and the backrest in their alternative positions and release when their positions are to be changed. Other arrangements may be used as well.

Figure 3:
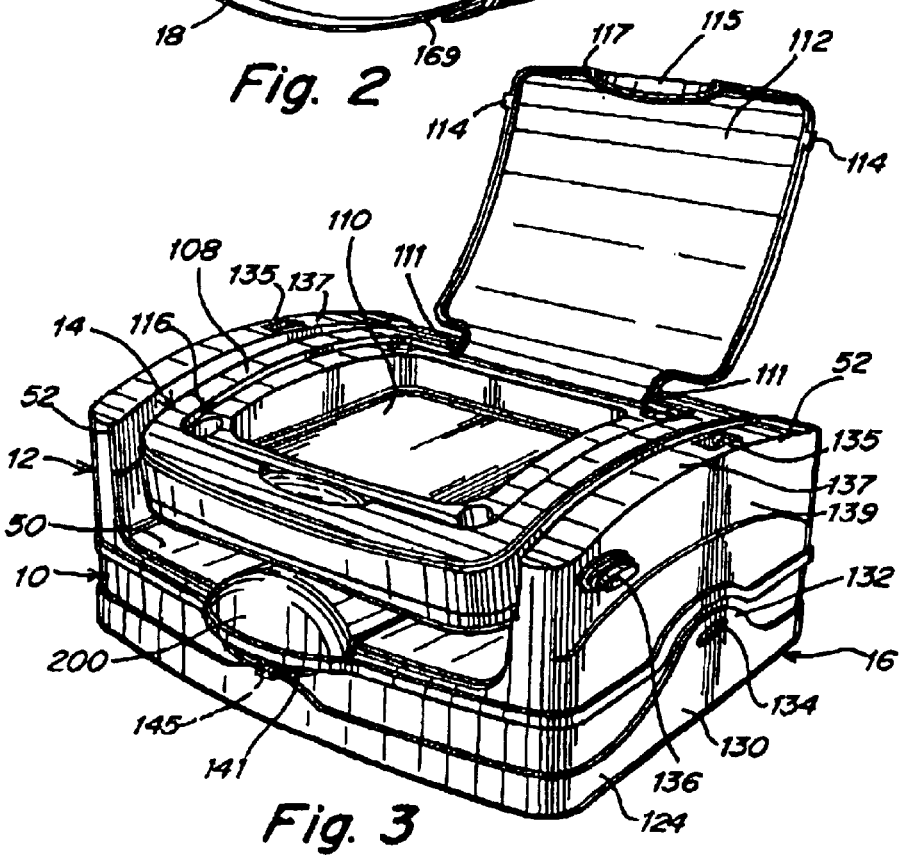
FIG. 3 is a front perspective view of the booster seat in a collapsed configuration with the tray attached to the bottom for storage or travel and showing the storage compartment in the backrest open.

In accordance with another aspect of the invention and as shown in FIGS. 3 and 9, the rear surface 108 of the back 14 may include a storage compartment 110 that is covered by a lid 112. The storage compartment 110 provides a convenient location for keeping sundry items in the booster seat particularly when it is moved from one location to another. In FIG. 3, the lid 112 is shown in the open position revealing the storage area. While the lid 112 is shown hinged to the back at 111 by pins carried at its corners and slots in the backrest (see FIG. 3), it may alternatively be removably mounted on the back and simply snap onto the backrest 14 in the closed position. Preferably however, the lid is hinged to the back so that it will not be misplaced. In the embodiment illustrated, flanges 114 are provided on the lid and slots 116 on the backrest to releasably hold the lid in the closed position, and a convenient finger grip 115 is provided in the free edge 117 of the lid to grasp it to overcome the latch so as to open the compartment 110. The flexibility of the material from which the lid is made enables it to bow slightly so that the flanges 114 can snap in and out of the slots 116. Other expediences may be used for that purpose as well.

In accordance with yet another aspect of the present invention, the removable tray 16 performs a dual function, namely, it serves as a conventional tray to hold food, toys, etc. for a child occupying the booster seat, and alternatively serves as a bottom cover for the base 10 to enclose the legs 20 and other operative parts of the booster seat as well when in the stored position. The latter position is most convenient when the booster seat is stored or being carried about. Shown in its tray functioning position in FIG. 1, tray 16 includes a shallow recess 122 in its upper surface to retain items placed on the tray such as toys, dishes, cups, and other sundry products. The tray has a peripheral skirt 124 that extends downwardly along the front and back edges 126 and 128 thereof as well as along the sides 130. The rear corners 131 of the skirt 124 carry connectors 133 (one shown in FIG. 2) in the form of hooks that extend into openings 135 on the upper surfaces 137 of the arms 52 and under the margins thereof to retain the rear of the tray in operative position. The skirt 124 along the sides 130 also includes extensions 132, each having an opening 134 that receives the tray locks in the form of bosses 136 on the outside surfaces 139 of the arms 52. While the openings 134 and bosses 136 are shown as being elliptical, obviously, they may be of other shapes. In accordance with one aspect of the invention, the bosses 136 may be spring biased to the extended position shown in FIG. 2 but may be depressed so as to lie within the arms 52 to enable the tray skirt 124 to be mounted in position over the arms with the openings 134 engaging the bosses. Once aligned with the bosses, the locks under the influence of the springs (not shown) extend the bosses into the openings 134 to retain the tray in place. The tray may readily be removed by depressing the bosses 136 to free the extensions 132 of the skirt 124 from them. Other attaching and locking means may be employed as well, but whatever means is used must dependably hold the tray firmly in place so that it will not accidentally detach from or tilt with respect to the seat and spill the tray contents on the floor or allow the child in the booster seat to fall out of the seat. As one alternative construction, the extensions 132 of the tray skirt 124 may possess sufficient flexibility to allow one or both to be bowed outwardly so as to snap over fixed bosses (rather than being spring loaded) or any other type of connector on the arms.

Figure 5:
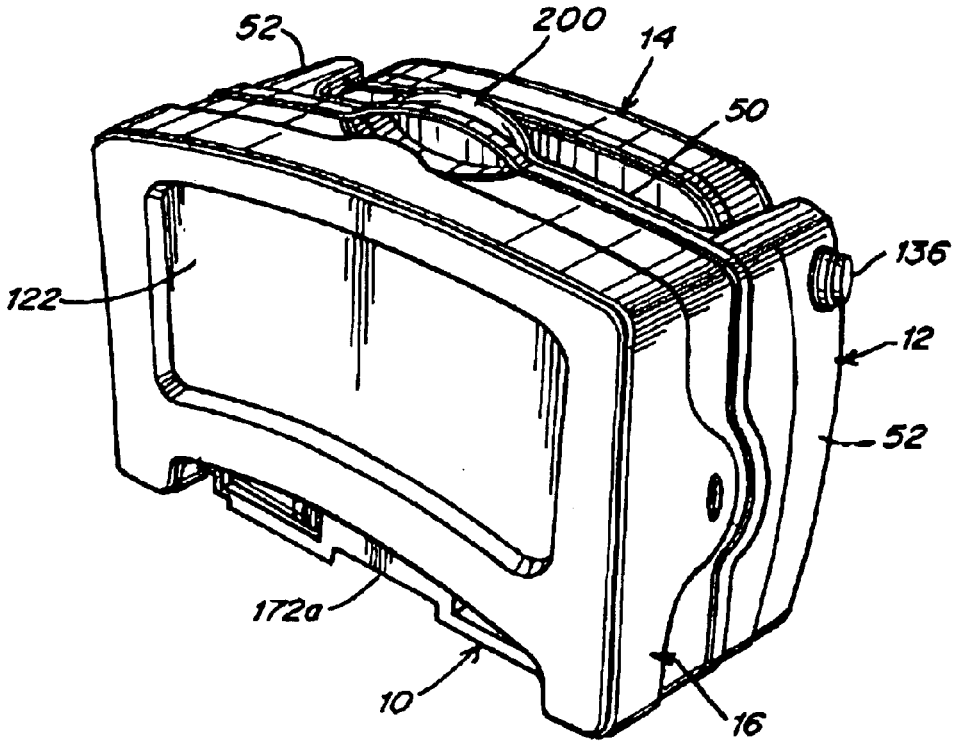
FIG. 5 is a bottom perspective view of the collapsed booster in the carrying position.

The alternative or stored position for the tray 16 is shown in FIGS. 3–5 attached to the bottom of the base 10 covering the surface 18 to enclose the folded legs 20 and other parts of the booster seat as described below. The openings 134 of the tray when the tray is mounted on the bottom of the base 10 may receive bosses or other forms of latches to hold the tray in place much like the bosses 136 on the arms 52 but carried on the sides of the base. Alternatively, fasteners in the form of flanges on the tray may releasably engage steps or recesses in the base to serve that purpose. In FIGS. 2, 3, and 9 a step 141 is shown at the center of the front edge 143 of the base 10 positioned to receive flange 145 carried on the inside of the tray skirt 124 at the front thereof to hold the front side of the tray in position on the bottom of the base. At the rear side of the base 10 (see FIG. 4), a pair of recesses 147 are provided that receive the hooks 133 at the rear corners of the tray 16 to hold the back of the tray 16 in place on the base 10. These latching devices are releasable because of the flexibility of the plastic so that the tray can be removed from and replaced on the base. Other latching arrangement may be used as well. When the tray 16 is mounted on the base, it provides a smooth, even surface for the booster when placed on a chair or other surface with the legs retracted, and as indicated, also conveniently stores in that position.

In accordance with yet another aspect of this invention, a strap assembly is provided to securely attach the booster seat to a chair or other support on which it is placed when in use. The straps connected to the booster and described in greater detail below may extend about the back and/or the support surface on which the booster rests. In FIGS. 6–9 the base 10 is shown to include a housing 150 that runs from front to rear along the central portion of the base. The housing 150 carries a pair of retractors 152 and 154 on the bottom surface 156 of the housing, and the retractors carry the straps for securing the base 10 of the booster seat on a chair with which the booster is used. The retractors 152 and 154 each include a spool 153 about which the straps are wound (see FIG. 8), a gear 155 on the bottom of each spool operatively connecting the two spools together, a post 157 coaxially mounted within each spool for connecting an end of a strap, and an axially extending slot 158 in the spool wall through which the end of the strap extends to connect to the post 157. The gears 155 are operatively connected together by a spur gear 159.

Figure 8:
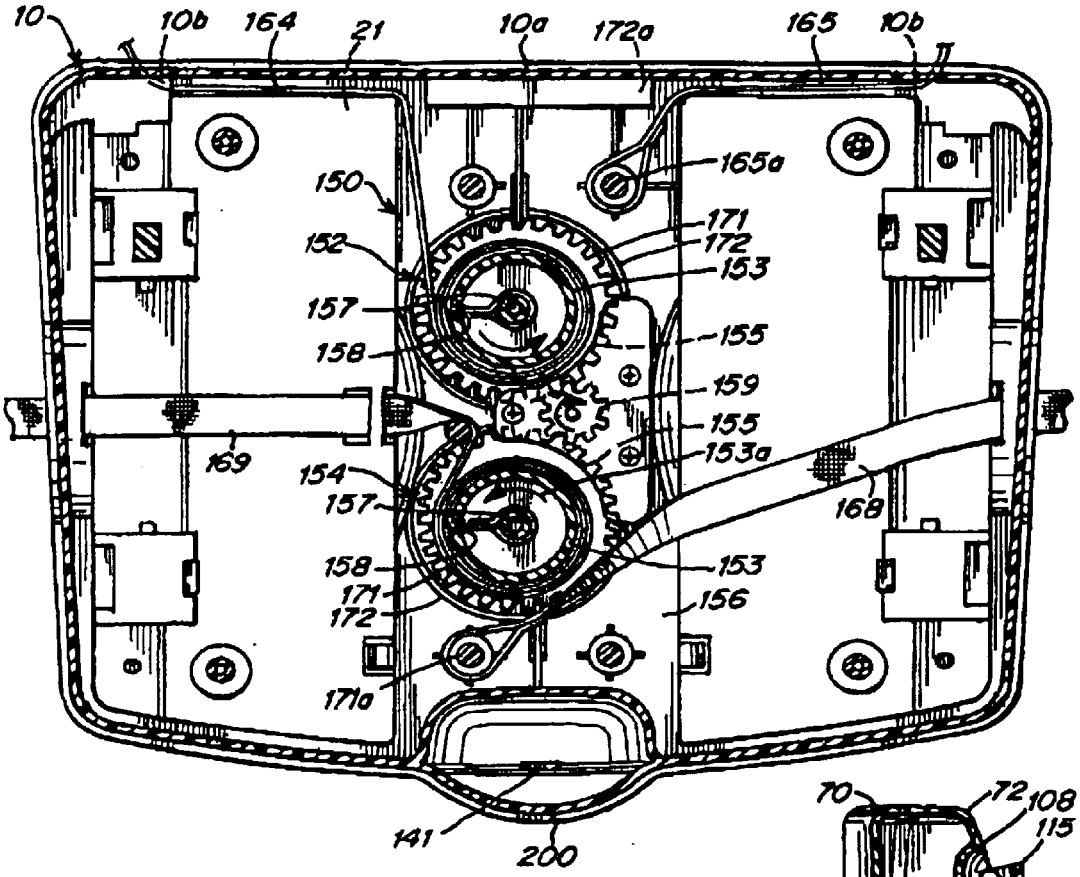
FIG. 8 is a cross-sectional top view of the booster taken along section line 8—8 in FIG. 7.

A pair of straps 164 and 165 are shown in FIGS. 4 and 8 to extend out of the rear wall 10*a* of the base through slots 10*b*, and carry male and female adjustable buckles 166 at their outer ends enabling the two straps to close about the back of a chair. The other end of strap 165 is anchored to post 165*a* in the back of the housing 150 (see FIG. 8). The other end of strap 164 is anchored to post 157 in spool 152 through slot 158 so that it may be wound onto that spool when strap 164 is to be retracted. The other pair of straps 168 and 169 that secure the booster to the seat of a chair also carry the two parts of a buckle 170 and are respectively anchored inside the housing 150 to fixed post 171*a* and post 157 of spool 154.

Figure 6:
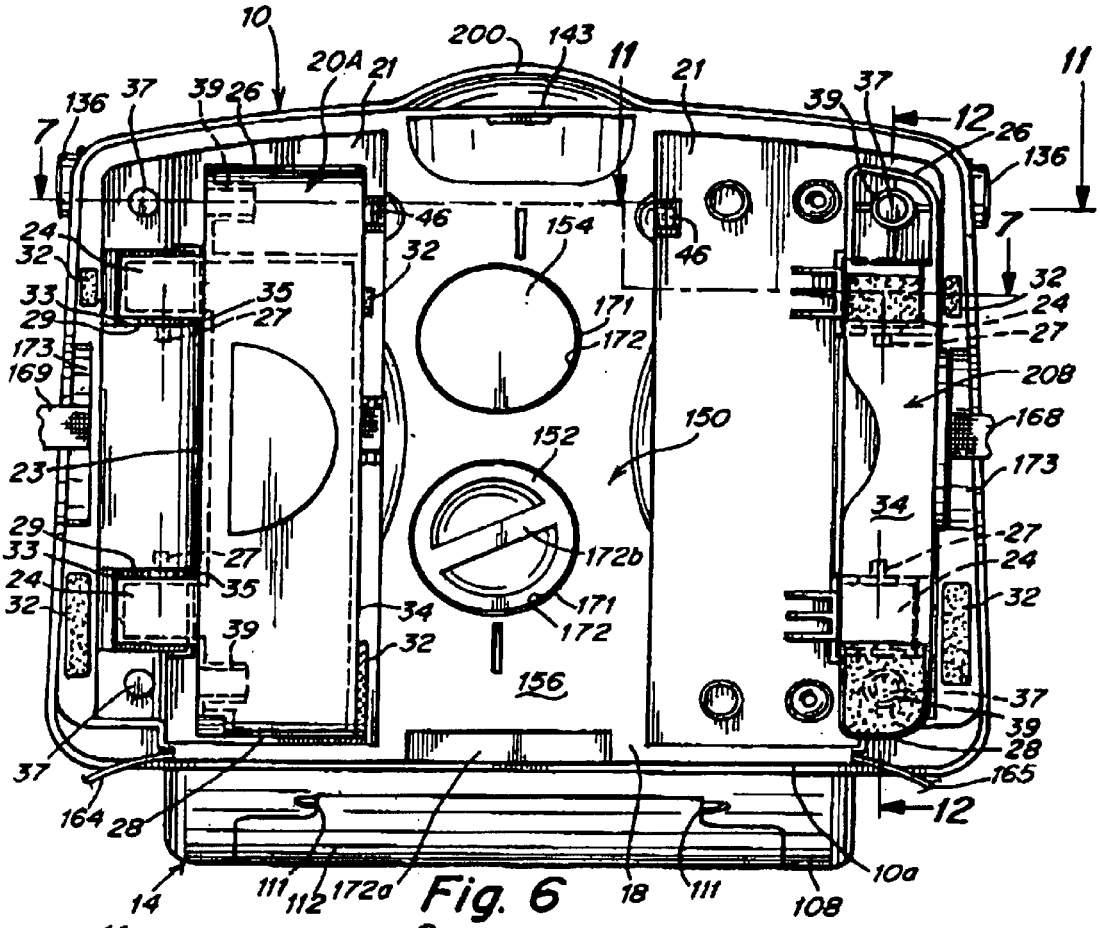
FIG. 6 is a bottom plan view of the booster with one leg extended and the other collapsed.

Openings 171 in the bottom wall 156 of the housing 150 surrounded by upwardly extending flanges 172 form seats for the spools 153 of retractors 152 and 154, and the retractors are exposed on the bottom of the base as shown in FIGS. 6 and 9. Retractor 152 carries a handle 172*b* on its bottom for turning the spools to retract the straps 164 and 169. It is apparent from FIG. 8 that when retractor 154 is turned counterclockwise as viewed from the top as suggested by arrow 153*a*, its spool 153 will retract strap 169, and through idler gear 159 retractor 152 will also turn and retract strap 164.

When the booster is to be strapped to a chair, straps 164 and 169 are fully extended (unwound from the spools 153) and wrapped around the back and seat of the chair, and the buckles 166 and 170 are closed. The exposed portions of straps 165 and 168 are relatively short and extend out of the base a short distance. Then by means of the adjustable half of the buckle (the male half of the buckle in the embodiment shown), the joined straps 164 and 165 and straps 168 and 169 are tightened about the back and seat of the chair. When the booster seat is to be removed, the buckles 166 and 170 are opened to free the booster, the male portions of the buckles are pulled to the ends of their respective straps, and the straps 164 and 169 are then retracted onto the spools 153 of retractors 152 and 154. A recess 172*a* may be provided in the rear wall 168 of the base for storing the free ends of the straps 164 and 165 with the buckle 166 when not in use. Recesses 173 on the sides of the base 10 are also available to store the buckle parts 170 and free ends of straps 168 and 169 when not in use. It should be appreciated that while one specific embodiment of the strap retraction mechanism has been described in detail, numerous modifications may be made thereof. For example, each of the retractors 153 may be made to operate independently of the other by eliminating the spur or idler gear 159 and providing a handle to rotate each spool separately. When the tray 16 is placed on the base as shown in FIGS. 3–5, the legs 20 along with the housing 150, handle 172*b* and buckle components 166 and 170 are enclosed.

The booster seat in accordance with another aspect of the invention may be provided with a harness 178 for retaining the child in the seat. Such an arrangement is shown in FIGS. 2, 7 and 9. The harness illustrated has a crotch strap 180 secured at its lower end to the underside of the seat 12 or the base 10. Additional straps 186 that extend out of the seating surface 50 through the slots 184 at the rear thereof or alternatively from the arms 52 of the seat 12 releasably connect to the top of the crotch strap 180 by means of buckles 190 and may extend over the shoulders and/or about the waist of the child. The child may readily be removed from the seat by opening the buckles 190. While one embodiment of the harness is shown, it is to be understood that a number of different types of harnesses may be used such as are widely used in booster seats, car seats, bouncers, high chairs, bassinets, etc.

In FIGS. 2 and 9, the booster seat is shown in its lower position for use by an older child and in FIG. 1 it is shown in its raised position for a younger child. In FIG. 3 the booster seat is shown in the stored configuration (with the exception of the lid 112) wherein the backrest 14 is folded down toward the seat surface 50 and disposed between the arms 52 and with the tray 16 attached to the base 10 on the bottom side thereof. The lid 112, however, is in the open position exposing the interior of the storage compartment 110 in the backrest 14. In FIG. 5 the booster seat is also shown in its collapsed configuration in position to be conveniently carried by its handle 200. It is apparent that the booster seat may be used without the tray 16, which is the usual configuration when placed on a chair adjacent a table for use by an older child. Having described this invention in detail, those skilled in the art will appreciate that numerous modifications may be made of this invention without departing from its spirit. For example, the various means for attaching the several parts together such as the seat to the base and the back to the seat may be varied, and the manner in which the tray 16 and legs 20 attach to the seat and base may also take different forms. Moreover, many of the different aspects of the invention are useful independent of the others. The invention does not require that a booster seat incorporate all of the different aspects of the invention or all of the various features described. Therefore, it is not intended that the scope of the invention be limited to an embodiment including all of the many aspects and features described in connection with the specific booster seat illustrated. Rather the scope of the invention is to be determined by the appended claims and their equivalents.

What is claimed is:

1. A booster seat comprising a generally rectangular base having front, side and back edges and top and bottom sides, a pair of legs pivotally connected to the bottom side of the base, one on each side thereof, and foldable between a first operative, generally perpendicular position extending downwardly from the base and a generally horizontal second position substantially parallel to the base, said first and second positions providing a height adjustment for the booster seat, a seat attached to the base and having front and back edges and a contoured seating surface, arms extending upwardly from the seat on each side thereof, said arms being integral with the seat, a backrest having top, bottom and sides and front and rear surfaces, said backrest being pivotally connected on sides adjacent the bottom edge thereof to the arms and movable between a collapsed position wherein the backrest lies closely adjacent and substantially parallel to the surface of the seat and an operative position wherein the backrest extends upwardly from adjacent the back edge of the seat, a storage compartment provided in the rear surface of the backrest and a lid attached to the backrest for opening and closing the compartment, and a tray removably attachable to the bottom side of the base for storage of the booster seat and removably attachable to the aims for use by a child seated in the booster seat.

2. A booster seat comprising a base and adjustable legs operatively attached to the base for raising and lowering the booster seat, a seat member on the base, said seat member having a backrest movable between stored and operative positions on the seat, a storage compartment in the backrest and having a cover for opening and closing the compartment, and a tray selectively mountable on the seat member and the base as a tray and enclosing the legs in the collapsed position, respectively.

3. A booster seat comprising a seat assembly including a seating surface and collapsible legs for adjusting the height of the seating surface, a backrest movably attached to the seat assembly for movement between an operative position and a collapsed position wherein the backrest lies closely adjacent the seat assembly, and a tray selectively mountable on the seat assembly between a first position adjacent the seating surface for use by a child seated on that surface and a second position wherein the tray encloses, on at least two sides, the legs in the collapsed position for storage.

4. A booster seat as described in claim 3 wherein a retractor assembly including at least one spool and a strap are attached to the seat assembly for releasably attaching the booster seat to a support on which the booster seat is to be used.

5. A booster seat comprising a base having a top and bottom, legs on the base, and movable between a first operative position extending downwardly below the base and a collapsed second position close to the base, said first and second positions providing a height adjustment for the booster seat, a seat assembly attached to the base and having front and back portions and a seating surface, said seat assembly including arms extending upwardly from the seating surface on the sides thereof and a backrest movable between a collapsed position wherein the backrest lies closely adjacent to the seating surface and an operative position wherein the backrest extends upwardly at the back of the seat assembly, a storage compartment provided in the backrest with a lid for opening and closing the compartment, and a tray alternatively attachable to the bottom of the base enclosing the legs for storage and to the seat assembly for use as a tray by a child seated in the booster seat.

6. A booster seat comprising a seat assembly and adjustable legs operatively attached to the assembly for raising and lowering the booster seat for use by a larger and smaller child, said seat assembly having a backrest movable between stored and operative positions on said assembly, and a tray selectively mountable in different positions on the seat assembly as a tray by a child in the booster seat and enclosing the legs for storage, respectively.

7. A booster seat as defined in claim 6 wherein the tray when mounted for storage covers the legs when the booster seat is configured to be used for a larger child.

8. A child's seat comprising a bottom portion including a seat assembly and having legs that move between an extended position for elevating the seat and a collapsed position for lowering the seat, a backrest attached to the seat and movable between a raised position with respect to the seat and a stored position closely adjacent the seat, and a tray connectable to the bottom portion in a first position for supporting articles for use by a child on the seat and second position enclosing the legs in the collapsed position.

9. A child's seating comprising a bottom assembly having top and bottom sides, a pair of legs pivotally mounted on the bottom side of the bottom assembly, and foldable between a first operative position extending downwardly from the bottom assembly and a generally horizontal position in the bottom assembly, said first and horizontal positions providing a height adjustment for the seating, a seat forming part of the assembly and having front and back portions and a contoured seating surface, arms extending upwardly from the seat on each side thereof, said arms being rigid with the seating surface, a backrest having front and rear portions, said backrest being pivotally connected adjacent the bottom portion thereof to the arms and movable between a collapsed position wherein the backrest lies closely adjacent and substantially parallel to the seating surface and an operative position wherein the backrest extends upwardly from the seat, a storage compartment provided in the rear portion of the backrest and a cover for opening and closing the compartment, and a tray removably attached to the bottom side of the bottom assembly for storage and alternatively removably attached to the arms for use by a child seated in the booster seat.

10. A booster seat comprising a seat having sides and arms on each side, legs attached to a base of the seat, a backrest connected to the seat, and a tray having at least three connectors removably attached to the arms in a use position and removably attached to the base in a storage position.

11. A booster seat according to claim 10 wherein the tray encloses the legs when the tray is in the storage position.

12. A booster seat according to claim 10 wherein the tray is flexible for enabling the tray to snap into and out of attachment with fixed bosses on the arms.

13. A booster seat according to claim 10 wherein the tray has holes for engaging spring biased bosses for holding and releasing the tray from the arms.

14. A booster seat according to claim 10 including a storage compartment provided in the backrest and a lid attached to the backrest for opening and closing the compartment.

15. A booster seat according to claim 10 wherein at least one of the seat, backrest and tray is made from injection molded polypropylene.

16. A booster seat according to claim 10 wherein the tray has at least one connector that extends into an opening of one of the arms for securing the tray to the arm when the tray is in a use position and wherein the connector extends into a recess in the base when the tray is in a storage position.

17. A booster seat according to claim 16 wherein the at least one connector is a hook.

18. A booster seat according to claim 10 wherein the legs extend generally perpendicular to the base in the use position and extend generally parallel to the base in the storage position.

19. A booster seat according to claim 10 wherein the tray has at least two connectors and at least two tray holes, in the use position each connector being adapted to secure the tray to a hole in one of the arms and each tray hole being adapted to secure the tray to a boss on a front portion of one of the arms.

20. A booster seat according to claim 19 wherein in the storage position each tray hole is adapted to secure the tray to a boss on a side of the base.

21. A booster seat according to claim 10 wherein the base has sides with recesses having at least one buckle part or strap free end and wherein the tray in the storage position encloses the legs and the least one buckle part or strap free end in the recesses.

22. A booster seat comprising a seat having sides and arms on each side, legs attached to a base of the seat, a backrest connected to the seat, and a tray having at least three connectors removably attached to the arms in a use position and removably attached to the base in a storage position wherein the tray has at least one connector that extends into an opening of one of the arms for securing the tray to the arm when the tray is in a use position and wherein the connector extends into a recess in the base when the tray is in a storage position, and wherein the tray has at least two connectors and a flange arranged at three points on the tray forming a triangle.

23. A booster seat comprising a seat having sides and arms on each side, legs attached to a base of the seat, a backrest connected to the seat, a tray, and means for connecting the tray to the arms in a use position and, alternatively, for connecting the tray to the base in a storage position wherein the tray encloses the legs when the tray is in the storage position.

24. A booster seat according to claim 23 wherein the tray has holes for engaging spring biased bosses for holding and releasing the tray from the arms.

25. A booster seat according to claim 23 wherein the means for connecting the tray includes at least one connector that extends into an opening of one of the arms for securing the tray to the arm when the tray is in a use position and extends into a recess in the base when the tray is in a storage position.

26. A booster seat according to claim 25 wherein the at least one connector is a hook.

27. A booster seat according to claim 23 wherein the means for connecting the tray includes at least two connectors and at least two tray holes, in the use position each connector being adapted to secure the tray to a hole in one of the arms and each tray hole being adapted to secure the tray to a boss on a front portion of one of the arms.

28. A booster seat according to claim 27 wherein in the storage position each tray hole is adapted to secure the tray to a boss on a side of the base.

29. A booster seat according to claim 23 wherein the base has sides with recesses having at least one buckle part or strap free end and wherein the tray in the storage position encloses the legs and the least one buckle part or strap free end in the recesses.

30. A booster seat comprising a seat having sides and arms on each side, legs attached to a base of the seat, a backrest connected to the seat, a tray, and means for connecting the tray to the arms in a use position and, alternatively, for connecting the tray to the base in a storage position wherein the means for connecting the tray includes fixed bosses on the arms and the tray being adapted to flex over at least one fixed boss enabling the tray to snap into and out of attachment with the fixed bosses.

31. A booster seat comprising a seat having sides and arms on each side, legs attached to a base of the seat, a backrest connected to the seat, a tray, and means for connecting the tray to the arms in a use position and, alternatively, for connecting the tray to the base in a storage position wherein the means for connecting the tray includes a flange arranged at three points on the tray forming a triangle and at least two connectors, one connector that extends into an opening of one of the arms for securing the tray to the arm when the tray is in a use position and extends into a recess in the base when the tray is in a storage position.

* * * * *